United States Patent [19]

Denemark et al.

[11] Patent Number: 4,951,362

[45] Date of Patent: Aug. 28, 1990

[54] LOW PROFILE BAG CLAMP

[75] Inventors: Philip W. Denemark, Bloomingdale; Donald Santucci, St. Charles, both of Ill.

[73] Assignee: Dek, Inc., St. Charles, Ill.

[21] Appl. No.: 405,730

[22] Filed: Sep. 11, 1989

[51] Int. Cl.[5] ..... B65D 63/10

[52] U.S. Cl. ..... 24/16 PB; 24/30.5 P

[58] Field of Search ..... 24/16 R, 20 K, 16 PB, 24/30.5 P, 17 A; 248/74.3; 292/318–321, 325

[56] References Cited

U.S. PATENT DOCUMENTS

| | | | |
|---|---|---|---|
| 3,146,012 | 8/1964 | King, Sr. | 24/16 PB X |
| 3,602,953 | 9/1981 | Thomas . | |
| 3,837,047 | 9/1974 | Bunneli . | |
| 4,223,424 | 9/1980 | Burnett . | |
| 4,272,870 | 6/1981 | McCormick . | |
| 4,319,285 | 3/1982 | Marchoru . | |
| 4,393,548 | 7/1983 | Herb . | |
| 4,483,556 | 11/1984 | LiVolsi . | |
| 4,499,680 | 2/1985 | Coburn . | |
| 4,507,828 | 4/1985 | Furutsa . | |
| 4,523,352 | 6/1985 | Wachter . | |
| 4,537,432 | 8/1985 | Meeks . | |
| 4,543,691 | 10/1985 | Calmettes . | |
| 4,615,185 | 10/1986 | Bollinger . | |

FOREIGN PATENT DOCUMENTS

| | | | |
|---|---|---|---|
| 2717622 | 10/1978 | Fed. Rep. of Germany | 24/16 PB |

*Primary Examiner*—James R. Brittain

*Attorney, Agent, or Firm*—R. Winston Slater

[57] ABSTRACT

An elongate plastic bag clamp or cable tie defined by a main strap portion, said strap having a plurality of teeth at a tip end thereof and a low profile strap engaging and locking head integrally formed at the other end thereof. The teeth are evenly spaced and oriented perpendicularly to the longitudinal axis of the strap. Further, the teeth are contoured, having a greater height along the center region thereof, to facilitate camming and locking engagement with the head. The head includes a pair of sidewalls extending from the strap and a plurality of semi-flexible retention bars rigidly affixed to, and spanning between, the sidewalls. Each retention bar is deformable in its center region under the camming influence of the strap teeth thereby to permit the passage and locking thereof.

5 Claims, 1 Drawing Sheet

LOW PROFILE BAG CLAMP

The present invention relates to cable ties and more particularly to a low profile, high tensile strength cable tie suitable for the interconnection of disposable vacuum cleaner bags.

A wide variety of cable tie products have been developed and are available from the marketplace Each, however, is directed to its specialized application and consequently incorporates structures and features specific thereto. Similarly the present cable tie has been developed with specific reference to the retention of vacuum cleaner bags although it will be appreciated that other uses, for example the clamping of tubing and hoses, is contemplated.

More specifically, the present clamp closely assumes the perimeter form of the conduit or other member on which it is positioned thereby to assure a proper, generally air-tight, closure between the bag and conduit. To achieve this end, the present bag clamp includes a head member integrally formed at one end of a clamp strap, the head member being adapted to receive, and lock, the opposed free end of the strap axially therein U.S. Pat. No. 4,537,432 to Meeks by contrast represents a prior art arrangement in which the strap is not oriented axially to the head, rather, is routed through the latch or head portion of the cable tie perpendicularly to the axis of the tie itself thereby forming a right angle at the point of tie latching. Such structures are known to create gaps between the tie and conduit and, further, to produce a latching arrangement of generally high profile, that is, one extending a greater distance radially from the conduit surface. Further, the present tie must withstand substantial tensioning forces and therefore single tooth or pivotal pawl latching arrangements of the Meeks variety are not considered satisfactory. See also Furutsu, U.S. Pat. No. 4,507,828, teaching a cantilevered single tooth engagement tie.

The U.S. Pat. Nos. 4,483,556 (LiVolsi), 4,499,680 (Coburn), and 4,615,185 (Bollinger), each teach straps having releasable locking means whereby the tie may be reused or readjusted. Reuse of the present clamp is not intended and therefore the above structures, with their attendant sacrifices in complexity, strength, and profile size, are not deemed appropriate.

Another cable tie of notoriously well-known configuration is the pivotal pawl type tie of which McCormick, U.S. Pat. No. 4,272,870, is seen as representative. Such ties perform satisfactorily in many applications but are not seen as affording the same low profile/high tensile strength capabilities of the present invention.

Metal ties are also known. Examples include the U.S. Pat. Nos. 4,223,424 (Burnett), 4,319,385 (Marchou), 4,523,352 (Wachter), and 4,543,691 (Calmettes), in which formed and specially folded metallic latching mechanisms are used in conjunction with metallic straps to effect the disclosed clamping systems. While such tie arrangements may possess adequate clamping qualities, the required implementation, including the use of multiple metallic parts and the complexities of installation, limits the acceptability of these devices where, as here, low cost and simplicity of installation are the bench marks.

As previously noted, it is an objective of the present invention to provide a low profile bag clamp, but one that can withstand substantial tensioning forces. The present clamp achieves this design objective through the use of a multiple engagement arrangement whereby a plurality of teeth, transversely oriented to the longitudinal axis of the tie at one tip end thereof, engage corresponding retention bars integrally formed and defining the latching head at the opposed end thereof.

The use of multiple engagement latching arrangements is not itself new. Known patents, in addition to certain of the previously discussed patents, include U.S. Pat. Nos. 3,602,953 (Thomas), 3,837,047 (Bunnell), and 3,837,047 (Herb). Each of these structures employ opposed families of interlocking teeth with some mechanism for assuring continuing engagement between the facing teeth. In Thomas, for example, a separate elastic clip member holds the opposed teeth in locking relationship. A pair of integral flanges are employed in Bunnell to force the teeth of the tip into engagement with the mating teeth of the head portion of the tie. Finally, the head portion of the Herb tie, formed by folding the tail section of the tie back upon itself, defines a parallelogram which, under the tension force of locking engagement, causes the parallelogram to elongate or compress thereby providing the requisite locking force.

The present bag clamp, by contrast, achieves the requisite locking interaction without resort to external or ancillary locking arrangements, the sole function of which being to hold opposed and mating teeth faces in abutting engagement.

Indeed the present tie incorporates but a single family of teeth positioned along the tip end of the clamp strap. In place of the second mating family of teeth ordinarily positioned at the tail end of the strap is an engagement and locking head which includes a series of spaced apart retention bars. The retention bars themselves function not merely as engagement members, but importantly as biasing members to assure proper engagement of the tip end teeth.

The retention bars are spaced adjacent to, and above, the strap a distance insufficient to admit the passage of the tip region of the tie strap and are oriented transversely to the longitudinal axis thereof.

Further, the retention bars are designed to resist deformation, but importantly, to in fact deform under the camming action generated by the passage of the strap teeth upon insertion of the tip region into the locking head. A pair of sidewalls are formed along each edge of the strap and define a portion of the locking head. These sidewalls serve to rigidly retain the opposed ends of each retention bar at the previously noted spaced relationship thereby defining a passageway in the locking head too narrow to allow the unrestricted passage of the strap tip end. The center region of the retention bars, however, do flex as required to admit passage of the strap teeth.

The teeth are contoured to complement, and operatively cooperate with, the retention bars. More specifically, in view of the narrow passage defined by the retention bars (and the negligible permitted movement of the locking bar ends), the strap teeth are tapered from a maximum dimension, generally at the middle of each tooth along the center longitudinal axis of the strap, to a minimum near zero dimension at the ends of each tooth, generally adjacent the edges or sides of the tie strap. The taper may be linear or curvilinear to fully complement the deformation of the locking bar upon tooth passage.

The teeth are further defined by a sloped forward surface which functions as a cam, contacting and urging the retention bars outwardly upon strap insertion, and by a generally perpendicular trailing surface which lockingly engages a retention bar to inhibit the withdrawal of the strap from the locking head. The retention bars literally snap back to their non-deformed position upon passage of the teeth thereby creating an interference condition between the several locking bars and corresponding strap teeth.

Significantly each locking bar/tooth interface provides an extremely strong latching action against the withdrawal of the strap by reason of the structure of the locking bar itself. The locking bar, as noted, is retained at both ends against motion in any direction and, therefore, provides an exceptionally strong lock against strap removal. Indeed shearing or substantial non-elastic deformation of the locking bar would be required to effect strap withdrawal. And furthermore, the use of plural locking bar/tooth interfaces permits fabrication of a strap of substantially any arbitrarily required tensile strength.

It will be further appreciated that the above described locking bar arrangement is self-biasing in that no additional structural elements are required to force or maintain the locking bar in firm engagement with the strap teeth. In each of the previously considered Thomas, Bunnell, and Herb patents, locking engagement between the facing tip and head teeth may be assured only upon the application of a biasing force acting on one or both sets of opposed teeth.

The foregoing and other objects and features of the invention will be further evident from the following detailed description of a preferred embodiment thereof and from the drawings.

DESCRIPTION OF THE PREFERRED EMBODIMENT

Figure 1:
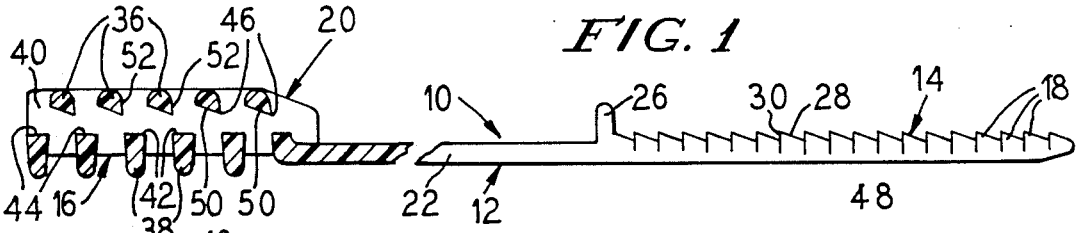
FIG. 1 is a front elevation view, partially in section along line 1—1 of FIG. 2, of the bag clamp of the present invention.
Figure 2:
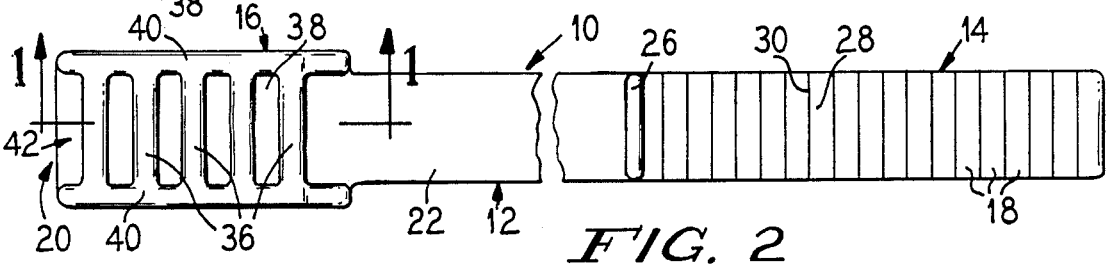
FIG. 2 is a top plan view of the bag clamp of FIG. 1.

With particular reference to FIGS. 1 and 2, the bag clamp 10 of the present invention is defined by an elongate generally flat strap 12 having a distal or tip end 14 and tail end 16. The bag clamp is preferably fabricated as a plastic injection molded product and includes a plurality of teeth 18 are formed along one surface of the tip end and a locking head 20 integrally interconnected at the opposed tail end of the strap.

As shown in FIGS. 4–8, and discussed in more detail below, the tip end of the clamp is inserted into, and engaged by, the locking head thereby defining a generally circular strap that serves to rigidly affix, for example a vacuum bag, to a vacuum cleaner exhaust chute.

Figure 8:
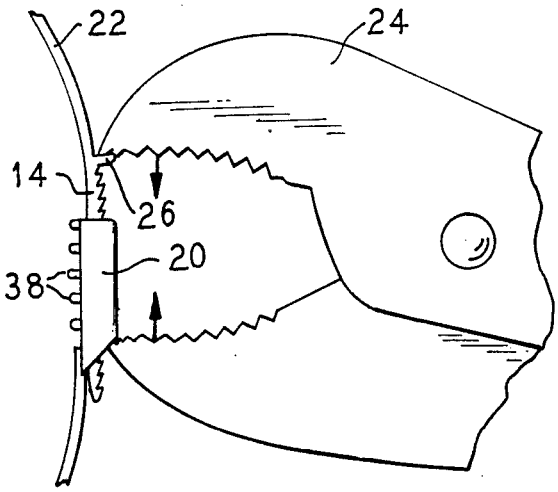

In those applications where a known use for the clamp is intended, the middle portion 22 of the clamp, i.e. that portion of the strap defined between the tip end 14 and the locking head 20, may be of predetermined fixed length, generally slightly less than the perimeter distance of the opening onto which the clamp is intended to be placed. The tip end 14 is then made correspondingly shorter thereby facilitating the installation of the clamp through the use of a plier-like tool 24 (FIG. 8).

More specifically, a tightening boss 26, integrally formed on the strap adjacent teeth 18, serves as an abutment member against which tool 24 acts in urging the tip end further into the locking head. In this manner clamp 10 can be placed under a substantial tension force which force, by reason of the plural locking bar arrangement described below, may be successfully accommodated.

Figure 3:
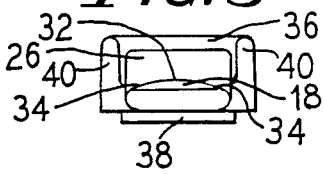
FIG. 3 is a right side elevation view of the bag clamp of FIG. 1.

While the present clamp is particularly suited for the retention of bags on the exhaust chutes of vacuum cleaner apparatus, it will be appreciated that the structure described herein may find utility in a wide variety of pipe or other clamp applications or, by increasing the ratio of the lengths of the tip end 14 to the middle strap portion 22, as a general cable tie or clamp having the capacity to remain firmly affixed even under the most adverse tension conditions Teeth 18 are shown with particular reference to FIGS. 1–3. Each tooth defines a gradually sloped forward surface 28 and a steep, generally normal to the plane of the strap, engagement face 30. As best illustrated in FIG. 3, teeth 18 are tapered from a maximum tooth height generally at the middle 32 of each tooth to a minimum or zero tooth height at the respective ends 34 of the teeth adjacent the strap edges. The taper may be linear or, as illustrated and discussed more fully below, a curvilinear contour that more nearly follows the corresponding deformation of the locking bars upon strap insertion.

The locking head 20 of the present invention, as best illustrated in FIGS. 1 and 2, includes a plurality of uniformly spaced locking bars 36 oriented above (as shown in FIG. 1) a plurality lower strap guides 38. The locking bars and strap guides are rigidly held in position by a pair of opposed integral sidewalls 40. The locking bars and strap guides are staggered, for reasons set forth below, such that each locking bar is oriented above, but between, a pair of adjacent strap guides, that is, above the space defined between such guides. Similarly, each strap guide is positioned below the space defined between adjacent locking bars.

Figure 6:
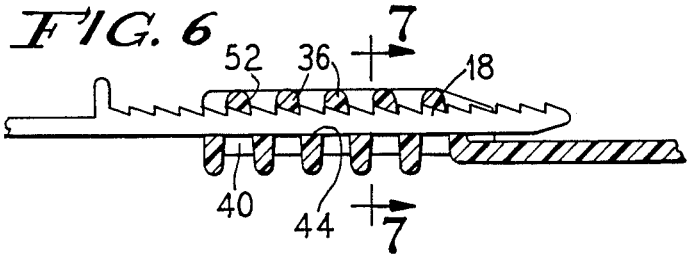
FIG. 6 is a front elevation view of the clamp of FIG. 1, with portions shown in section along line 1—1 of FIG. 2, shown in the locked position.
Figure 7:
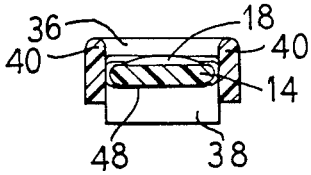
FIG. 7 is a sectional view taken along line 7—7 of FIG. 6 shown in the locked position; and, FIG. 8 is a pictorial view of the bag clamp illustrating installation using a pliers-like tool.

The sidewalls 40, locking bars 36, and strap guides 38 in combination define a channel 42 in the locking head through which the tip end 14 of the strap passes upon clamp installation and locking. As detailed below, once inserted, the strap tip remains rigidly locked within this locking head channel (FIG. 6). The width of channel 42 is defined by the spacing between respective sidewalls 40 and, as illustrated in FIG. 7, is preferably slightly greater than the width of the clamp strap itself.

The height of channel 42, as defined by the distance between the upper surfaces 44 of guides 38 and the forward crests 46 of locking bars 36, is more critical for proper clamp operation. This distance should approximate the minimum thickness of the strap tip end, that is, the thickness of the strap between teeth 18. The relationship between strap thickness and channel height is considered in more detail below.

Figure 4:
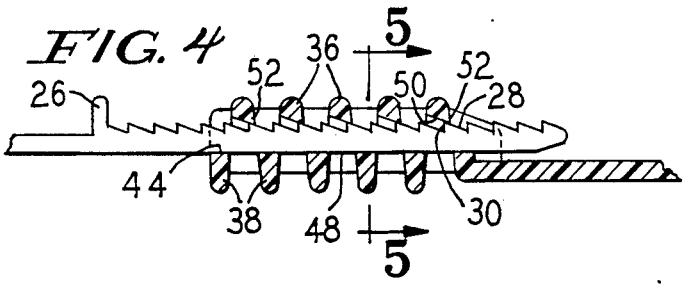
FIG. 4 is a front elevation view of the clamp of FIG. 1, with portions shown in section along line 1—1 of FIG. 2, shown during insertion of the clamp tip end into the locking head.
Figure 5:
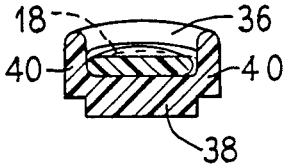
FIG. 5 is a sectional view taken along line 5—5 of FIG. 4 of the clamp of FIG. 1 shown during insertion of the clamp tip end into the locking head.

As shown in FIGS. 4–6, the upper surfaces 44 of the strap guides lie in a common plane thereby forming a flat surface on which the bottom 48 of the strap may slide and against which the strap is biased upon locking insertion. The strap guides are preferably formed of sufficient cross-sectional area to resist deformation upon strap insertion although, alternatively, the strap guides may be deformable to aid or admit strap passage.

Each locking bar 36 defines a sloped lower surface 50 and a substantially vertical (i.e. normal to the longitudinal axis of the strap) engagement face 52 which two surfaces generally correspond and mate, as set forth below, teeth surfaces 28 and 30, respectively.

More specifically, the lower sloped surfaces 50 of the locking bars are gradually sloped, approximately of the same slope as that of teeth surfaces 28, and serve to cammingly receive and admit passage of strap teeth (FIG. 4) upon insertion of the strap tip end 14 into the locking head 20. Similarly, upon strap insertion, the respective teeth and locking bar engagement faces 30 and 52 abuttingly coact to inhibit the reverse movement or withdrawal of the strap from the locking head.

The cross-sectional area of the locking bars 36 is generally less than that of strap guides 38 whereby the locking bars may be elastically deformed by the camming interaction of the strap teeth against the locking bars, but importantly, whereby the locking bars nevertheless have sufficient resistance to firmly lock the strap against withdrawal. It will be appreciated that substantially any degree of bag clamp tensioning can be withstood simply by increasing or decreasing the number of locking bars until the requisite tension strength has been achieved. The use of five locking bars has been found to afford a satisfactory margin of tensile strength over actually required tension for the vacuum bag clamp application.

As outlined above, the several locking bars 36 are staggered with respect to the strap guides 38 whereby each is essentially positioned above or below the space defined between the respective opposed guides and bars. This arrangement is highly advantageous for the integral injection molding of the present cable clamps in that steel mold members (not shown), used to define and form the locking bars and strap guides, may thereby be positioned during molding in the opposed spaces and thereafter withdrawn.

FIGS. 4–7 best illustrate the insertion and locking engagement of the strap tip end 14 into the locking head 20. As noted, the nominal spacing between the locking bars and strap guides, i.e. the quiescent spacing as it exists without the external influence of an inserted strap (FIG. 1), is selected such that the crests 46 of the locking bars generally seat in the recesses or valleys between the strap teeth 18 without causing deformation of the locking bars. This condition is illustrated in FIGS. 6 and 7. It will be appreciated, therefore, that the locking head channel 42 is too narrow to admit the unrestricted entry of the tip end of the strap.

Therefore, upon insertion of the strap tip end into the locking head (the rightward movement of the tip end relative to the locking head, FIGS. 4 and 6) the sloped surfaces 28 of the teeth 18 engage the corresponding sloped surfaces 50 of the locking bars 36. As additional insertion forces are applied, the camming action between these respective sloped surfaces 28 and 50 deflect the locking bars upwardly (as depicted in FIGS. 4 and 5) or outwardly from the plane of the bag clamp.

It will be observed that the deflection of the locking bars occurs generally in the center regions 54 thereof This is due in part to the previously discussed contoured teeth design in which the height of the teeth tapers from the midpoints 32 in both directions to a substantially lowered or zero height at the edges of the strap. Indeed use of contoured teeth is an important feature of the present invention by reason that the end portions of the locking bars are rigidly affixed to the head sidewalls 40 and consequently are precluded from significant deformation.

The camming action depicted in FIGS. 4 and 5 continues until the uppermost extension of the teeth clear the respective locking bar crests 46 at which instant the locking bars snap downwardly to assume their prior, undeflected and unbiased position. This latter or locking position is shown in FIGS. 6 and 7.

The longitudinal spacing between the several locking bars 36 is made equal to the spacing between teeth 18 thereby assuring that all of the locking bars will assume their non-deformed locking orientation substantially at the same instance, that is, at the same position of the adjacent strap. In this manner a plurality of locking bars (five shown) will simultaneously engage complementary teeth on the strap to effect a multi-point locking retention thereof. More specifically, the engagement between the teeth and locking bars will again be predominantly in the center regions thereof which, in turn, will permit the locking bars to each deflect longitudinally along the axis of the bag clamp. The independent deflections of the locking bars results in the dividing of the overall tension force more evenly between the several engagement members thereby increasing the overall tension force that may be accommodated by a clamp of a given number of locking bars.

What is claimed:

1. A clamping device for applying a force around one or more objects including an elongated flexible strap, the strap having a first region with a plurality of teeth thereon and a second region with means for locking the first region thereto; each of the first region teeth having a sloped camming surface and an engagement surface; the locking means defining a channel into which the first region of the strap is inserted for locking engagement therein; at least two locking bars positioned at spaced intervals along the length of the channel, each locking bar having a sloped camming surface and an engagement surface, the locking bars being rigidly affixed at opposed ends thereof to the locking means and being elastically deformable upon passage of the strap first region through the channel; the locking means channel being dimensioned such that the teeth and locking bars camming surfaces interferingly engage upon insertion of the strap first region into the locking means thereby comprising a means for entire elastically deforming the locking bars along substantially their entire lengths to admit passage of the strap first region, said locking bars returning to their non-deformed position after passage of each of the first region teeth whereby the respective teeth and locking bar engagement surfaces are in abutting and locking relationship preventing the withdrawal of the strap first region from the locking means and whereby locking engage between the first and second regions is achieved without use of cantilever pawl members.

2. A clamping device for applying a force around one or more objects including an elongated flexible strap defined along a central longitudinal axis, the strap having a first region with a plurality of teeth extending therefrom, said teeth being arranged perpendicularly to the strap axis, and a second region with means for locking the first region thereto; each of the first region teeth having a sloped camming surface and an engagement surface, and each of the teeth having a contoured height profile, the profile being defined by a maximum teeth extension generally at the midpoints thereof and tapering therefrom to a minimum dimension at both opposed ends of each of the teeth; the locking means having a channel into which the first region of the strap is inserted for locking engagement therein, said channel having a width defined and bounded between a pair of opposed sidewalls and a height defined and bounded between a lower guide means and an upper teeth engagement means; the upper engagement means comprising at least two locking bars at spaced intervals along the length of the channel, each locking bar having opposed first and second ends, the ends being rigidly affixed to the sidewalls thereby constraining the ends against movement relative to the channel, each locking bar having a sloped camming surface and an engagement surface; the height of the channel being less than the height of the first region of the strap with the teeth thereon whereby the insertion of the first region of the strap into the locking means channel causes an interference engagement between the respective teeth and locking bar camming surfaces thereby comprising a means by which the entire center portions of the locking bars between said first and second ends are deformed outwardly to admit teeth passage and whereby the locking bars return to their non-deflected positions following teeth passage to preclude strap first region withdrawal and whereby locking engage between the first and second regions is achieved without use of cantilever pawl members.

3. The clamping device of claim 2 wherein the lower guide means is comprised of at least two guide bars at spaced intervals along the channel, the locking bars and the guide bars being staggered along respective opposed sides of the channel whereby the guide bars are oriented opposite the spaces defined between to the locking bars and whereby the locking bars are oriented opposite the spaces defined between or adjacent to the guide bars thereby permitting the positioning of tool members between the locking and guide bars during the molding of the clamping device.

4. The clamping device of claim 3 wherein the cross-sectional area of the guide bars is greater than the cross-sectional area of the locking bars thereby minimizing deflection of the guide bars upon strap tip end insertion.

5. A clamping device for applying a force around one or more objects including a generally flat elongated flexible strap defined along a central longitudinal axis, the strap width defined between its opposed edges and a height defined by the strap thickness, the strap having a first region with a plurality of teeth extending from a first side thereof, said teeth being arranged generally perpendicularly to the strap axis, and a second region with means for locking the first region therein; each of the first region teeth having a sloped camming surface and an engagement surface, and each of the teeth having a contoured height profile, the profile being defined by a maximum teeth extension generally at the midpoints thereof and tapering therefrom to a minimum dimension at both opposed ends of each of the teeth; the locking means having a channel into which the first region of the strap is inserted for locking engagement therein, said channel having a width defined and bounded between a pair of opposed sidewalls, the channel width being greater than the strap width, and a height defined and bounded between a lower guide means and an upper teeth engagement means; the upper engagement means comprising at least two locking bars at spaced intervals along the length of the channel, each locking bar having opposed first and second ends, the ends being rigidly affixed to the sidewalls thereby constraining the ends against movement relative to the channel, each locking bar having a sloped camming surface and an engagement surface; the height of the channel being substantially equal to or slightly greater than the thickness of the strap whereby the insertion of the first region of the strap into the locking means channel causes an interference engagement between the respective teeth and locking bar camming surfaces thereby comprising a means by which the entire center portions of the locking bars between said first and second ends are elastically deformed outwardly to admit teeth passage and whereby the locking bars return to their non-deflected positions following teeth passage to preclude strap first region withdrawal and whereby locking engage between the first and second regions is achieved without use of cantilever pawl members.

* * * * *